US008156873B1

(12) United States Patent
Olson

(10) Patent No.: US 8,156,873 B1
(45) Date of Patent: Apr. 17, 2012

(54) RAIL BIKE

(76) Inventor: Scott Olson, Waconia, MN (US)

( * ) Notice: Subject to any disclaimer, the term of this patent is extended or adjusted under 35 U.S.C. 154(b) by 38 days.

(21) Appl. No.: 11/462,162

(22) Filed: Aug. 3, 2006

(51) Int. Cl.
*B61B 3/00* (2006.01)

(52) U.S. Cl. ..... 104/89

(58) Field of Classification Search ..... 104/53, 104/89, 91, 106, 118, 162, 165
See application file for complete search history.

(56) References Cited

U.S. PATENT DOCUMENTS

| | | | | | |
|---|---|---|---|---|---|
| 639,778 | A | * | 12/1899 | Shakespear | 104/119 |
| 3,192,872 | A | * | 7/1965 | Parent | 104/93 |
| 3,568,605 | A | | 3/1971 | Pettit | |
| 4,445,502 | A | | 5/1984 | Swan et al. | |
| 4,548,136 | A | * | 10/1985 | Yamada | 105/91 |
| 4,911,426 | A | | 3/1990 | Scales | |
| 4,928,601 | A | | 5/1990 | Harder et al. | |
| 5,458,550 | A | | 10/1995 | Braim et al. | |
| 5,461,984 | A | * | 10/1995 | Andress, III | 104/243 |
| 5,468,199 | A | | 11/1995 | Keeler et al. | |
| 5,592,883 | A | | 1/1997 | Andress, III | |
| 5,709,154 | A | * | 1/1998 | Schott | 105/29.1 |
| 6,062,173 | A | | 5/2000 | Heinrichs | |
| 6,105,507 | A | | 8/2000 | Jelf et al. | |
| 6,315,138 | B1 | | 11/2001 | Dyson | |

* cited by examiner

*Primary Examiner* — S. Joseph Morano
*Assistant Examiner* — R. J. McCarry, Jr.
(74) *Attorney, Agent, or Firm* — Haugen Law Firm PLLP

(57) ABSTRACT

A recreational apparatus is provided having an elevated rail system with a carrier suspended therefrom. The carrier has a frame that is slidably coupled to the rail system by a coupling assembly. The carrier includes a pedal assembly coupled to a wheel assembly. The wheel assembly is configured such that when the pedal assembly is engaged the wheel assembly will cause the coupling assembly to advance along the elongate pathway defined by the elevated rail system.

3 Claims, 11 Drawing Sheets

RAIL BIKE

FIELD OF THE INVENTION

The present invention relates generally to the field of exercise and recreational devices. More particularly, the present invention relates to an elevated rail system for use with a manually operated carriage suspended therefrom.

BACKGROUND OF THE PRIOR ART

The prior art provides a number of stationary cardiovascular exercise machines. Such machines include treadmills, stationary bicycles, elliptical machines, rowing machines and the like. These devices are commonly found at health clubs and in private residences.

A problem with such prior art machines is that they can become monotonous to use. The user is stuck in a single position for the entire duration of an exercise session.

U.S. Pat. No. 4,928,601 attempts to address this problem by providing a monorail system having a track on a top side thereof for receiving and guiding the tires of a traditional bicycle on a top side of the monorail system track. A user may then ride the bicycle around on the monorail track. A problem with this prior art system is that the bicycles must be fitted with a special apparatus in order to avoid physical contact with other bicycles. Additionally, bicycles must ride in-line with each other, preventing one user from passing another or achieving a speed faster than a bicycle positioned in front of the user.

A further problem with the above system is that it is limited to the use of bicycles at the exclusion of other types of cardiovascular exercise machines.

It would, therefore, be advantageous to provide a system that overcomes these and additional shortcomings of the prior art.

SUMMARY OF THE INVENTION

The present invention provides a recreational apparatus and travel apparatus that includes an elevated rail system and a carrier suspended therefrom.

The carrier includes a frame and drive assembly such as a pedal assembly such that, for example, a rider may comfortably ride in the carrier and access the drive assembly, such as with his or her legs in the case of a peddle assembly. The drive assembly may be coupled, such as via a chain, to a wheel assembly or other such motive assembly, which causes the carrier to advance along the elevated rail system when the drive assembly is operated by the rider.

The frame is slidably suspended from the elevated rail system by a coupling assembly. The coupling assembly may incorporate one or more sets of rollers for slidably contacting the frame to the rail.

The coupling assembly is connected to the frame of the carrier such that the motive assembly or wheel assembly provides the driving force for advancing the coupling assembly along an elongate pathway defined by the rail.

The elevated rail system may incorporate a plurality of interlinked pathways wherein one or many carriers may advance along any number of such pathways. For example, the rail system may include any number of diverters having a single pathway that leads to multiple pathways, wherein any of such pathways may be selectively taken by a carrier.

The carrier may further include any number of performance features including but not limited to a hand brake for slowing the drive wheel assembly, a hand throttle for adjusting the frictional force between the drive wheel and rail, and an adjustable guide for preselecting one of a plurality of paths along the rail system.

A variety of different carrier arrangements and configurations may be utilized in accordance with the present invention, including but not limited to a bicycle configuration, an elliptical machine configuration, a rowing machine configuration and a treadmill machine configuration or other such exercise equipment configurations.

These and various other features and advantages of the present invention shall be described in more detail in the following sections.

DETAILED DESCRIPTION OF THE PREFERRED EMBODIMENTS

Figure 1:
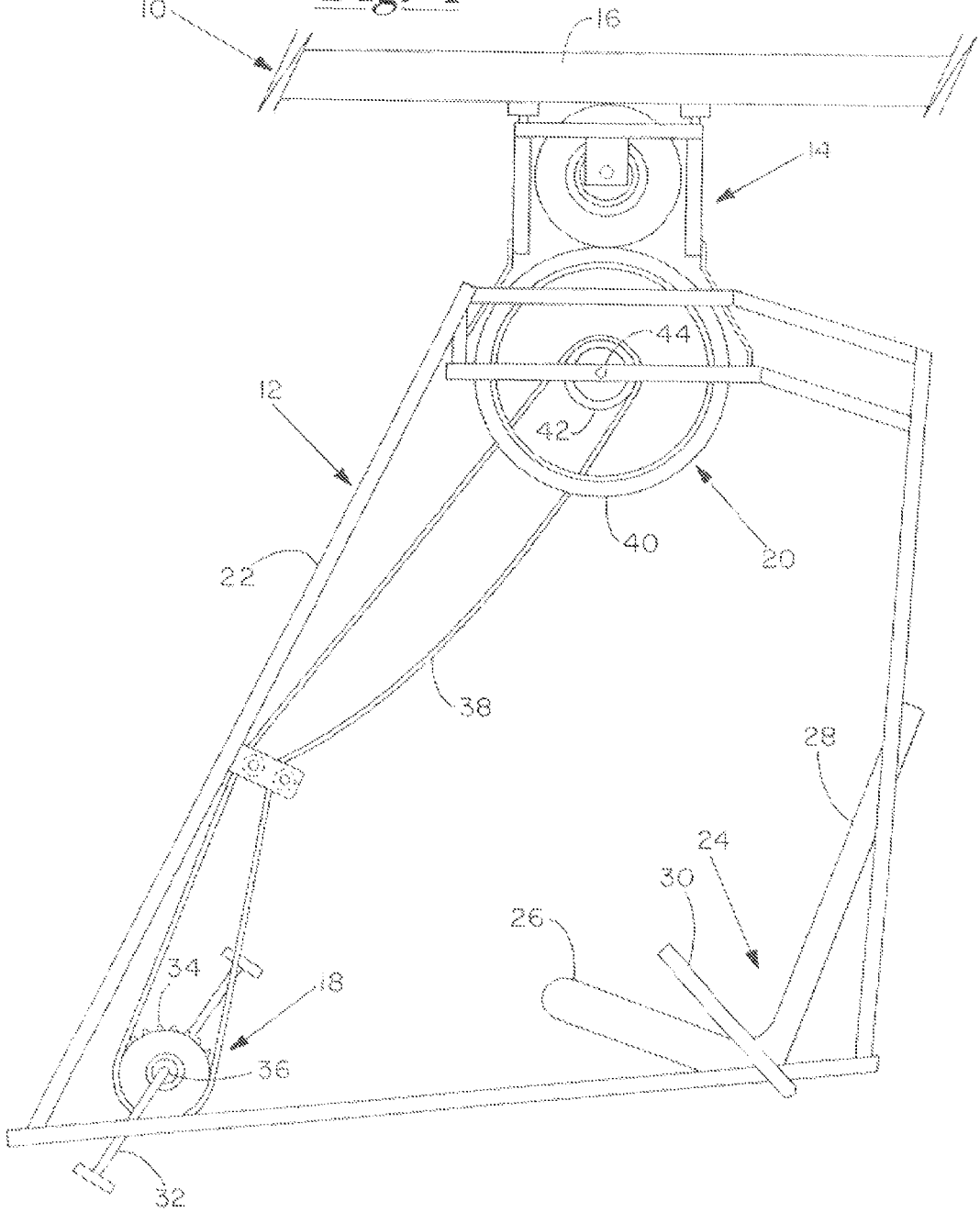
FIG. 1 illustrates a side view of an elevated rail system and carrier suspended therefrom.

FIG. 1 illustrates an elevated rail system 10 defining an elongate pathway about which a carrier 12 is able to travel. The carrier 12 is suspended from the elevated rail system 10 by a coupling assembly 14 configured to slidably engage the rail 16 of the elevated rail system 10. The carrier 12 is advanced along the rail 16 by engaging a pedal assembly 18 that is operably coupled to a drive wheel assembly 20.

In the present embodiment, the carrier 12 includes a frame 22 for supporting a seat assembly 24 and pedal assembly 18 such that the pedal assembly 18 is accessible therefrom. As shown, the seat assembly 24 includes a seat portion 26, a back support 28 and one or more handles 30 on opposing sides of the seat assembly 24.

The pedal assembly 18 of the present embodiment is a crank 32 and gear system 34 as is common in the art and is rotatable about an axis 36 supported by a lower portion of the frame 22. A chain 38 couples the pedal assembly 18 to the wheel assembly 20.

The wheel assembly 20 of the present embodiment includes a wheel 40 rotatable by a gear system 42 when the pedal assembly 18 is engaged. It is contemplated that the gear system 42 may include shiftable gears such that the chain 38 may be selectively positioned on any one of a plurality of parallel gears.

An upper section of the frame 22 provides an axis 44 for the wheel assembly 20 and further provides one or more connecting members 46, 47 for selectively securing the frame 22 of the carrier 12 to the coupling assembly 14.

Figure 2A:
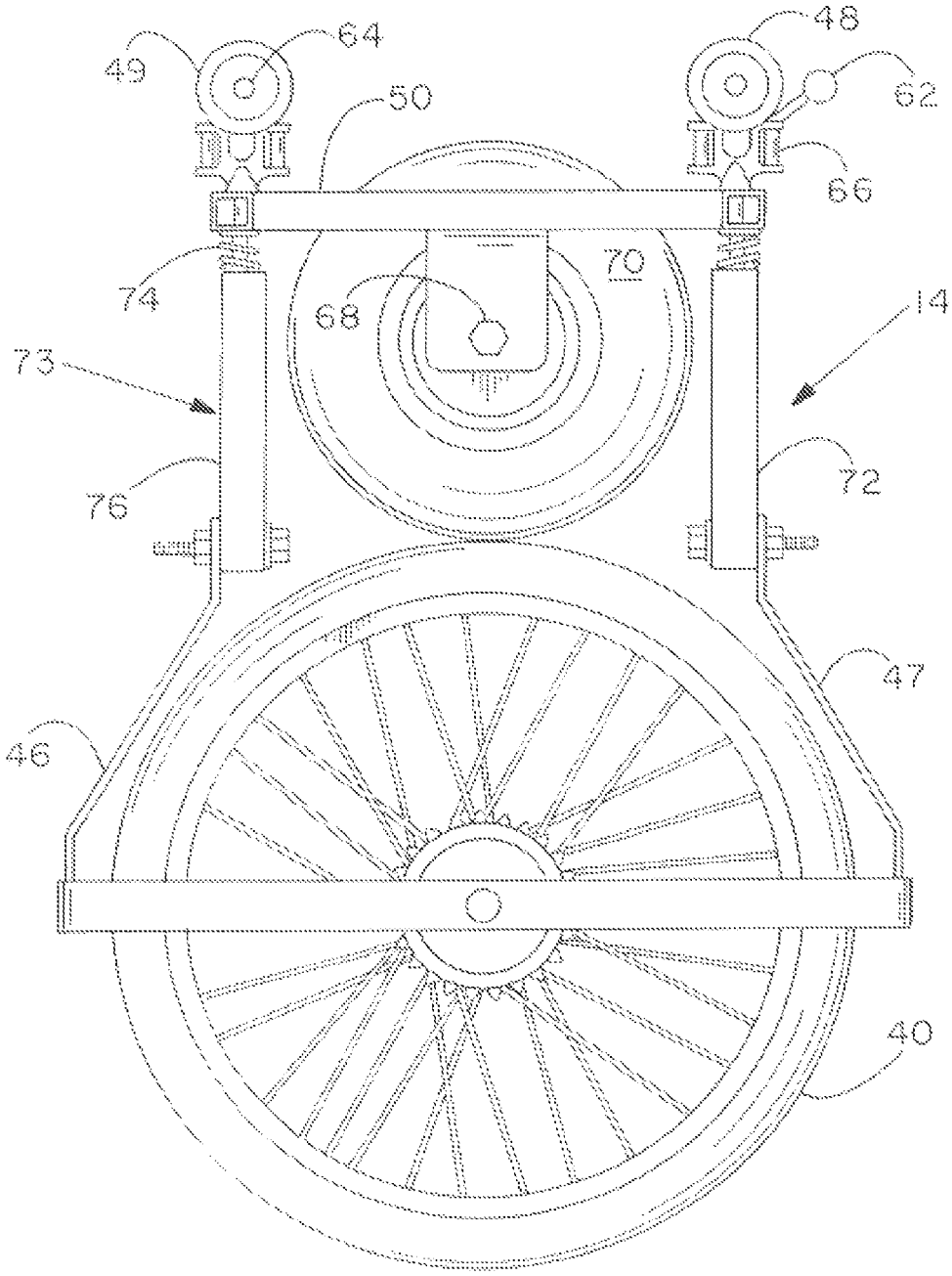
FIG. 2A illustrates a side view of a coupling assembly.
Figure 2B:
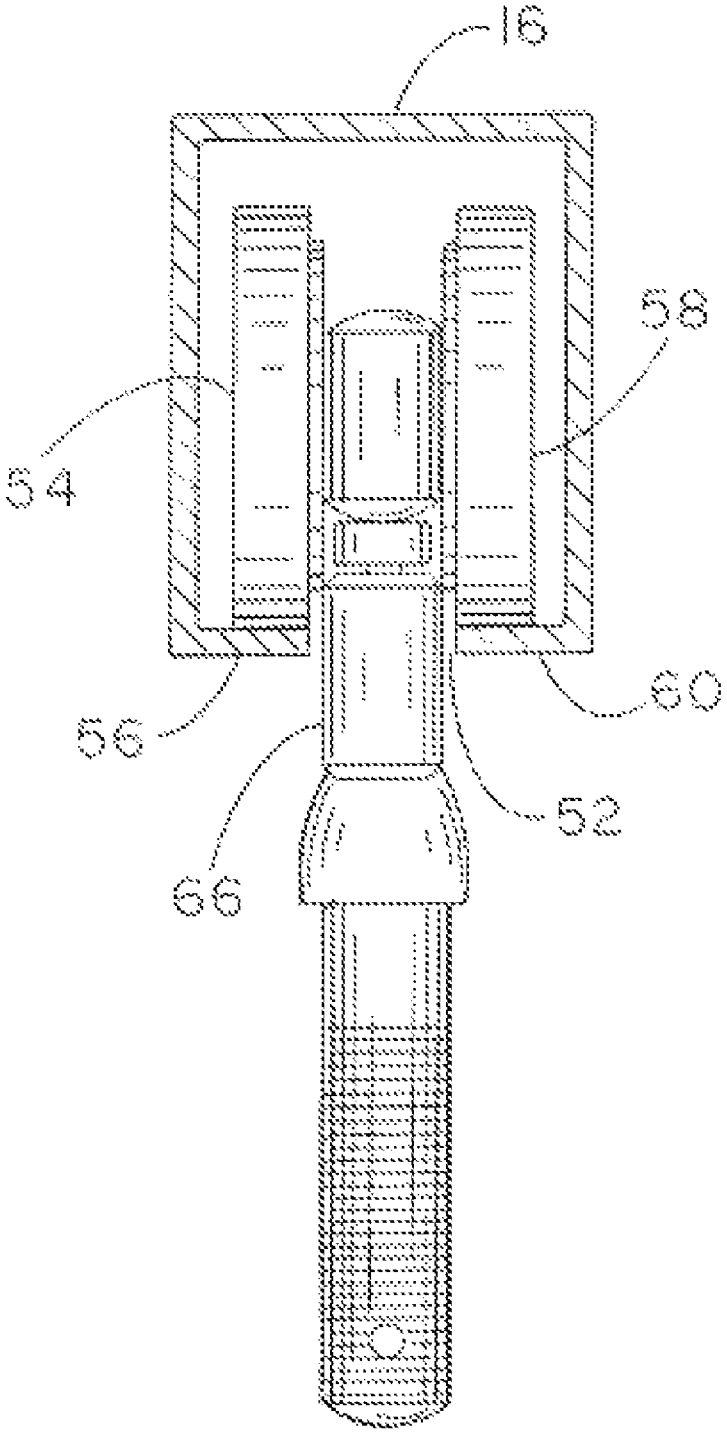
FIG. 2B illustrates a front view of the coupling assembly from FIG. 2A.

FIGS. 2A and 2B illustrate a more detailed view of the coupling assembly 14 of the present embodiment. A first and second set of rollers 48, 49 are spaced from each other about a coupling frame 50. The rollers 48, 49 are configured to be received within a channel 52 of the elevated rail system 10 such that the coupling frame 50 is suspended therefrom. The rollers 48, 49 thus are slidably received within the channel 52 of the elevated rail system 10. In the present embodiment each set of rollers 48, 49 includes a first roller 54 received on a first lip 56 of the channel 52 and a second roller 58 received on a second lip 60 of the channel 52 and to rotate about an axis 64 such that a periphery of the roller 54, 58 contacts the lip 56, 60 of the channel 52 respectively.

A limit roller 62 or fin extends from a fixed section of the axis 64 such that the limit roller 62 extends within the channel 52 of the rail 16. The limit roller 62 prevents the coupling assembly 14 from swinging from side to side with respect to the elongate pathway defined by the rail 16. It is further contemplated that the elongate rail system 10 may include a plurality of intersecting pathways. In such case, the fin 62 may be selectively positioned to guide the coupling assembly 14 into a predetermined one of said plurality of pathways.

The rollers 48, 49 are connected to the coupling frame 50 by one or more guide rollers 66 that extend about a generally vertical axis through the channel to connect to the coupling frame 50. The coupling frame 50 of the present embodiment further provides a fixed axis 68 for a translation wheel 70. The translation wheel 70 rotates about the axis 68 so as to simultaneously contact the bottom surface of the rail 16 and the top surface of the drive wheel 40 of the carrier 12. In operation, the rotation of the drive wheel 40 will cause the translation wheel 70 to rotate in the opposite direction and thus drive the carrier 12 along the elongate pathway in accordance with the rotation of the translation wheel 70.

It is contemplated that the chain 38 extending between the pedal assembly 18 and drive wheel assembly 20 may be configured such that the translation wheel 70 may be eliminated and the drive wheel 40 makes direct contact with the rail 16 wherein a forward pedal motion will result in a forward motion of the carrier 12 along the rail 16.

Returning now to the present embodiment, the connecting members 46, 47 of the carrier are each connected to the coupling frame 50 via a corresponding tension member 72, 73. The tension member 72, 73 of the present embodiment incorporates a threaded inner sleeve 74 and corresponding outer connecting sleeve 76. The outer sleeve 76 may be adjusted with respect to the inner sleeve 74 to selectively increase or decrease the frictional contact between the drive wheel 40 and the translation wheel 70.

It is contemplated that the tension member 72, 73 could alternatively be used to selectively increase or decrease direct functional contact between the drive wheel assembly 20 and the rail 16 in an embodiment of the present invention wherein the translation wheel 70 has been eliminated.

In this or other embodiments described herein, it is contemplated that a number of controls and coupling systems may be accessible and/or operable from the handle 30 of the seat assembly 24. For example, a hand brake may be coupled to brake pads positioned about the drive wheel 40; a guide may be coupled to the fin 62 for selectively choosing a pathway; a throttle may be coupled to the tension member(s) 72, 73 to selectively adjust the tension between the drive wheel 40 and the rail 16; and additional such controls and coupling systems may be incorporated and operably accessible from the seat assembly 24.

Figure 3:
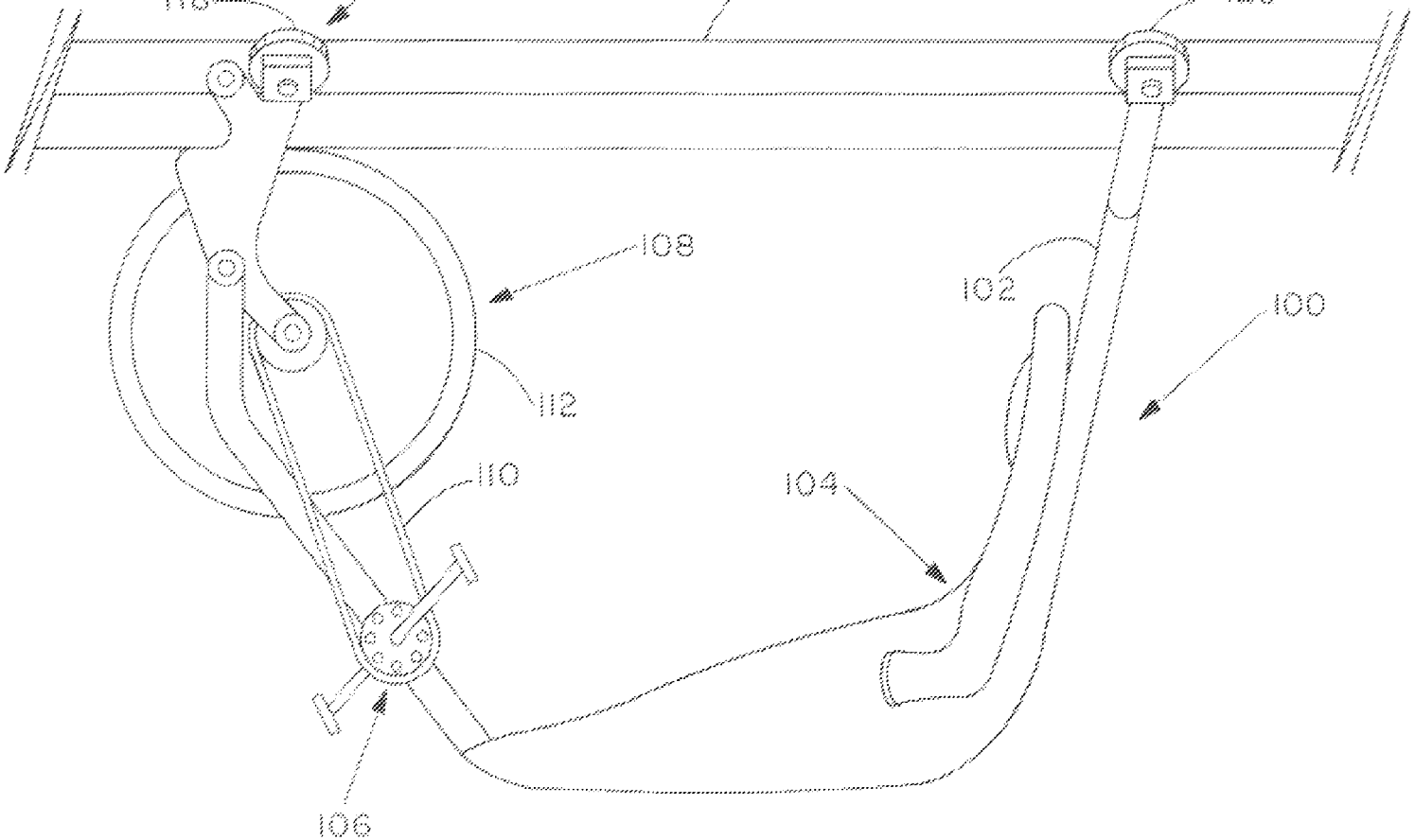
FIG. 3 illustrates a side view of an alternative embodiment of an elevated rail system and carrier suspended therefrom.

FIG. 3 shows an alternative embodiment of the present invention wherein the carrier 100 includes a frame 102 having a seat assembly 104 at a rear portion thereof and a pedal assembly 106 at a front portion thereof. The pedal assembly 106 is coupled to a drive wheel assembly 108 by a chain 110 such that the drive wheel 112 rotates when the pedal assembly 106 is engaged. The drive wheel 112 is in direct contact with a bottom surface of the elevated rail 114 to advance the carrier 100 along the rail 114.

In this embodiment, the coupling assembly 116 includes a front set of rollers 118 that are configured to contact an upper surface of the rail 114 to support the front section of the frame 102, suspended therefrom. A rear set of rollers 120 are configured to contact an upper surface of the rail and support the rear section of the frame 102.

Figure 4:
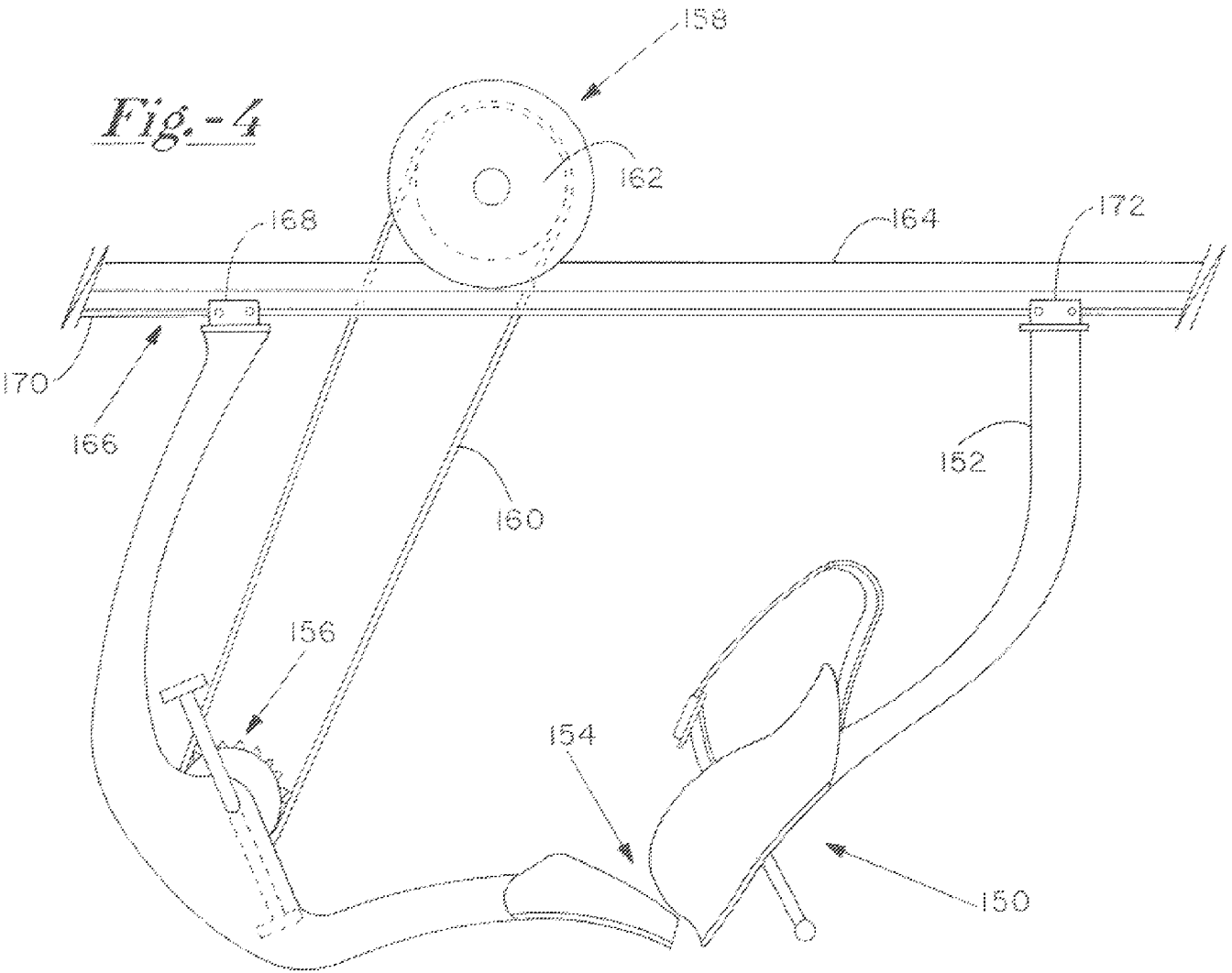
FIG. 4 illustrates yet another embodiment of an elevated rail system and carrier suspended therefrom.

FIG. 4 illustrates yet another embodiment of the present invention wherein the carrier 150 includes a frame 152 having a seat assembly 154 at a rear portion thereof and a pedal assembly 156 at a front portion thereof. The pedal assembly 156 is coupled to a drive wheel assembly 158 by a chain 160 such that the drive wheel 162 rotates when the pedal assembly 156 is engaged. The drive wheel 162 is in direct contact with a top surface of the elevated rail 164 to advance the carrier 150 along the rail 164.

In this embodiment, the coupling assembly 166 includes a front set of rollers 168 that are received within a channel 170 in a bottom section of the rail 164 to support the front section of the frame 152, suspended therefrom. The rear set of rollers 172 are also received within the channel 170 through the bottom section of the rail 164 to support the rear section of the frame 152, suspended therefrom.

It is further contemplated that as an alternative to a drive wheel wheel assembly a turbine drive assembly may be incorporated with the various embodiments of the present invention. In such case, the pedal assembly would be coupled to a turbine for converting mechanical energy from the pedal assembly into air flow to provide a hovering capability to the coupling assembly. The turbine drive assembly would allow the coupling assembly to float along a surface of the rail without making direct contact therewith.

Figure 5:
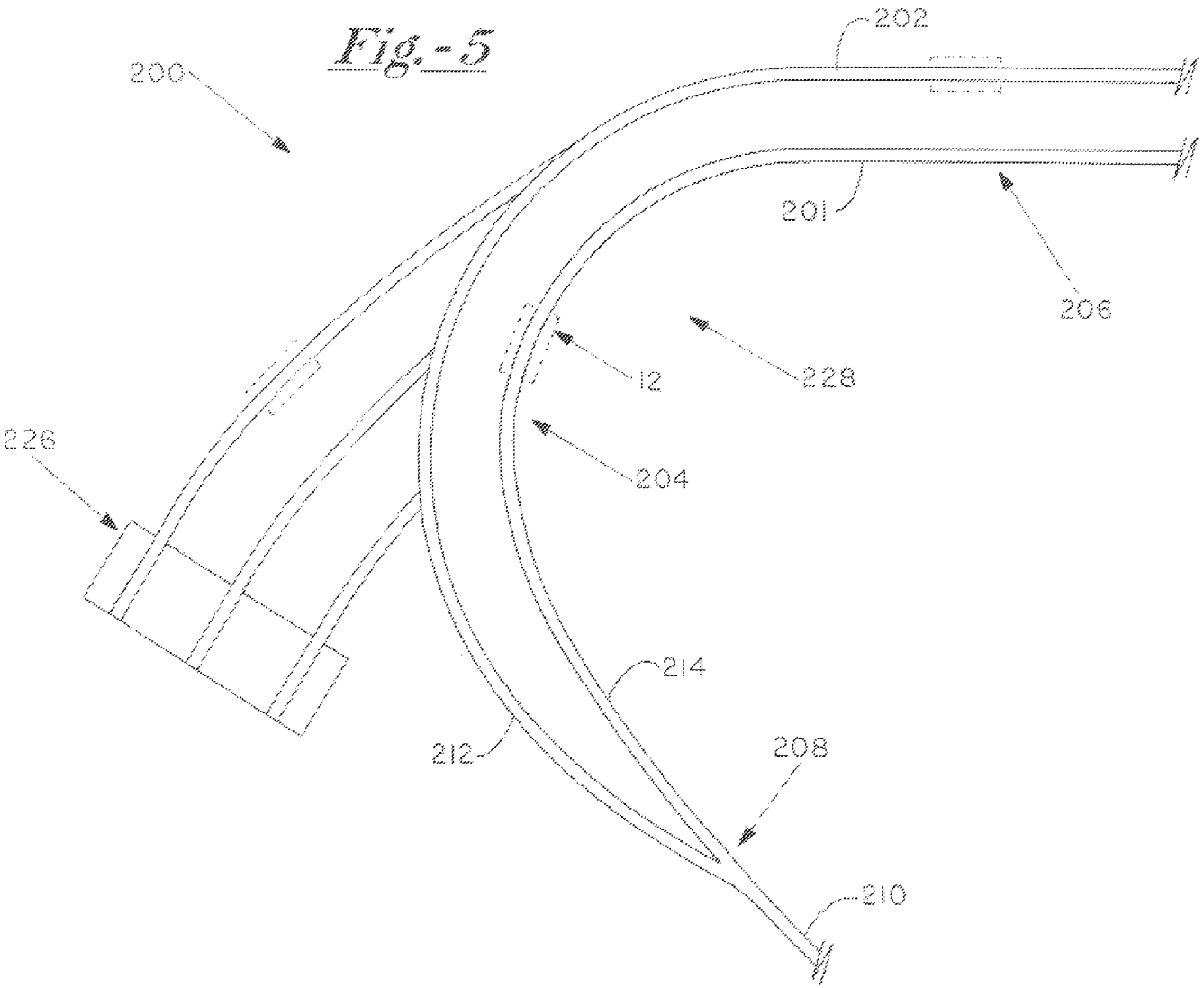
FIG. 5 illustrates a perspective view of an interlinked rail system.

FIG. 5 illustrates an embodiment of an elevated rail system 200 in accordance with the various embodiments of the present invention. The rail system 200 includes a plurality of interlinked elongate pathways 201, 202. The elongate pathways 201, 202 may include one or more curved sections 204, straight sections 206 and/or combinations thereof.

The elevated rail system may be supported by a variety of support means. The rail system may be suspended from a ceiling or other such elevated support structure or the rail system may be suspended by support beams extending from a ground surface to an underside of the rail system. For example, an inverted U-shaped support beam would be supported by the ground surface while allowing the carrier to advance along the rail system. Any suitable support means may be employed in accordance with the nature, location and operation of the carrier and elevated rail system.

Figure 6:
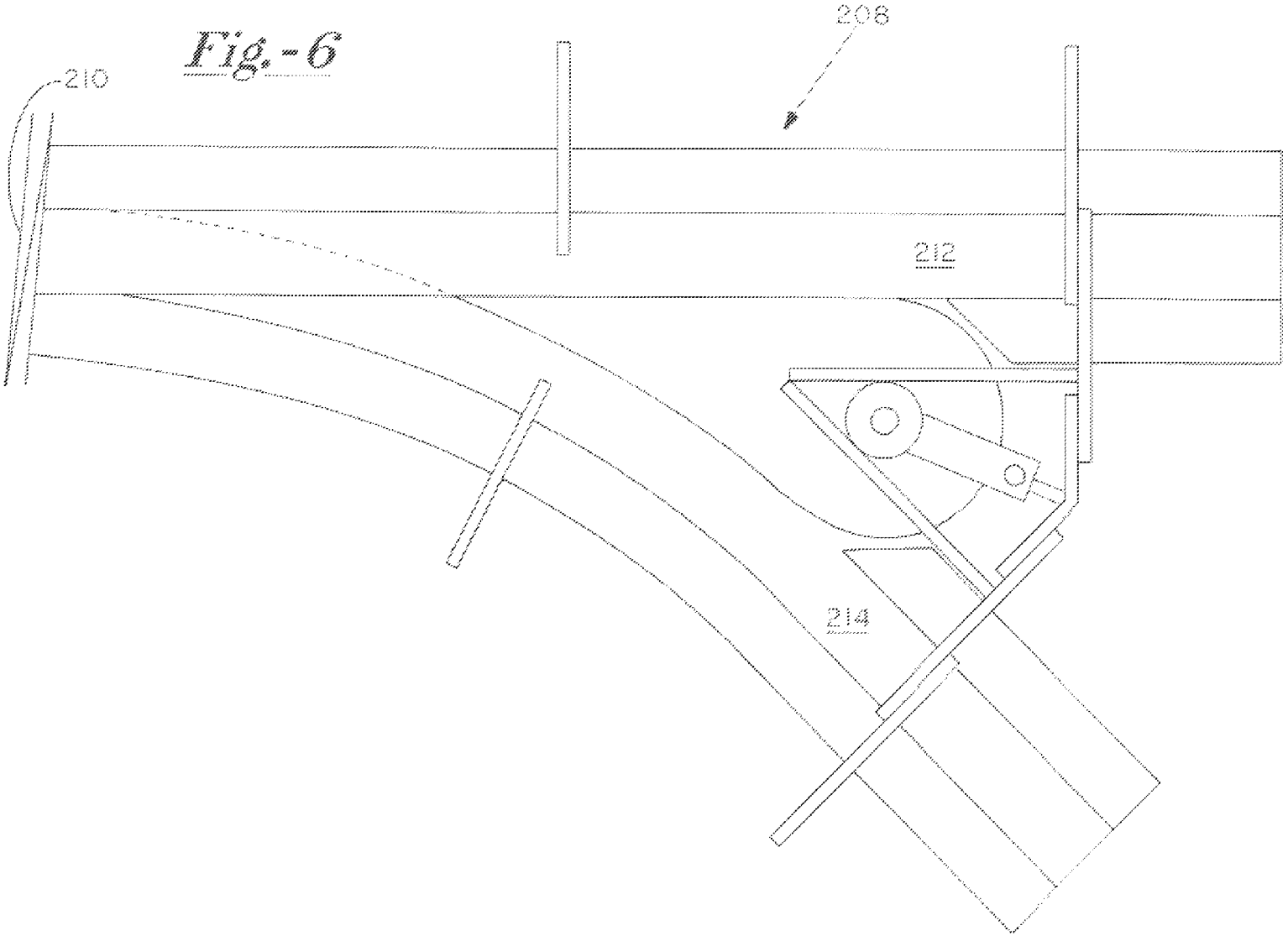
FIG. 6 illustrates a bottom view of an embodiment of a diverter for an elevated rail system.

FIG. 6 illustrates a diverter 208 for use in interlinking one elongate pathway with another. The diverter 208 includes a first approach channel 210 and a pair of selectable channels 212, 214 extending therefrom. The rollers 48, 49 of the coupling assembly 14 from FIGS. 2*a* and 2*b*, for example, are received within the channel 210 and supported by opposing lips of the channel 210 The fin 62 of the coupling assembly 220 may be selectively adjusted to guide the rollers 48, 49 and coupling assembly 14 into one of the selectable channels 212, 214 in accordance with the preferences of an operator of the carrier 12.

Returning now to FIG. 5, the elevated rail system 200 may include a loading area 226 for allowing operators to enter and exit a carrier 12 and to interchange carriers. One or more diverters 208 may be provided for allowing carriers from the loading area 226 to enter the recreational section 228 of the elevated rail system 200. A plurality of carriers 12 may be operated on the rail system 200 such that the carriers 12 may selectively travel along the various interlinked pathways 201, 202.

It is contemplated that sections of the rail system 200 may be abraded, such as for example the loading area 226 in order to provide additionally frictional engagement between the rail system 200 and the drive wheel 40 of the carrier 12, for example.

One embodiment of the elevated rail system 200 incorporates a plurality of substantially parallel pathways, such as for defining lanes of a racing track, such as is commonly found in health club running tracks and out door field tracks, wherein one or more diverters are positioned along each lane of the track to allow a carrier to be selectively guided to different lanes of the track.

It is contemplated that any number of elevated rail constructions and arrangements may be utilized in accordance with the present invention including but not limited to the solid rail shown in FIG. 3, the channeled rail shown in FIG. 1 and FIGS. 2A and 2B, the T-shaped rail shown in FIG. 4 or a cable such as used on a tram or ski-lift wherein any number of suitable corresponding coupling assemblies may also be incorporated therewith.

Figure 7:
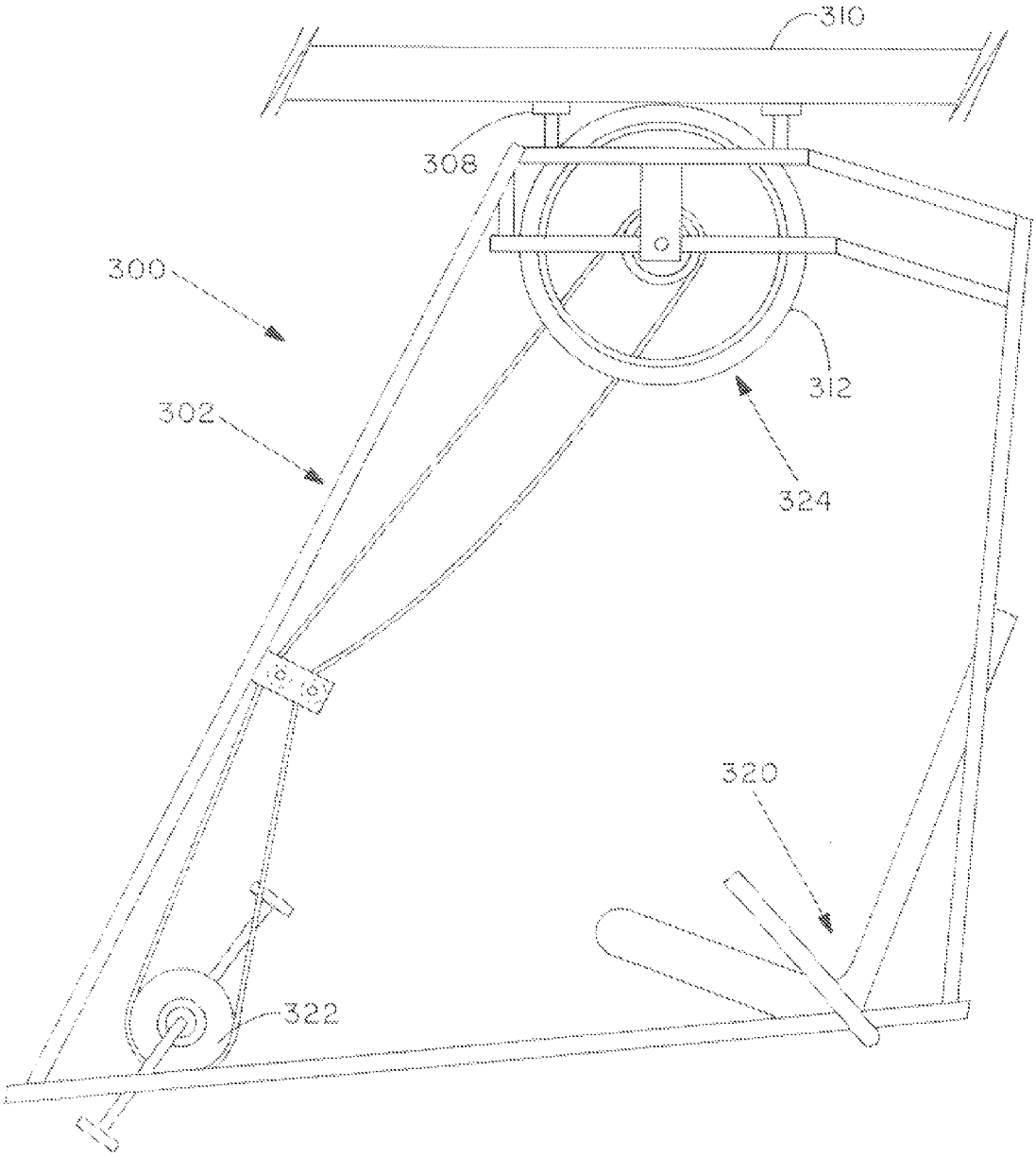
FIG. 7 illustrates a further embodiment of an elevated rail system and carrier suspended therefrom.
Figure 8:
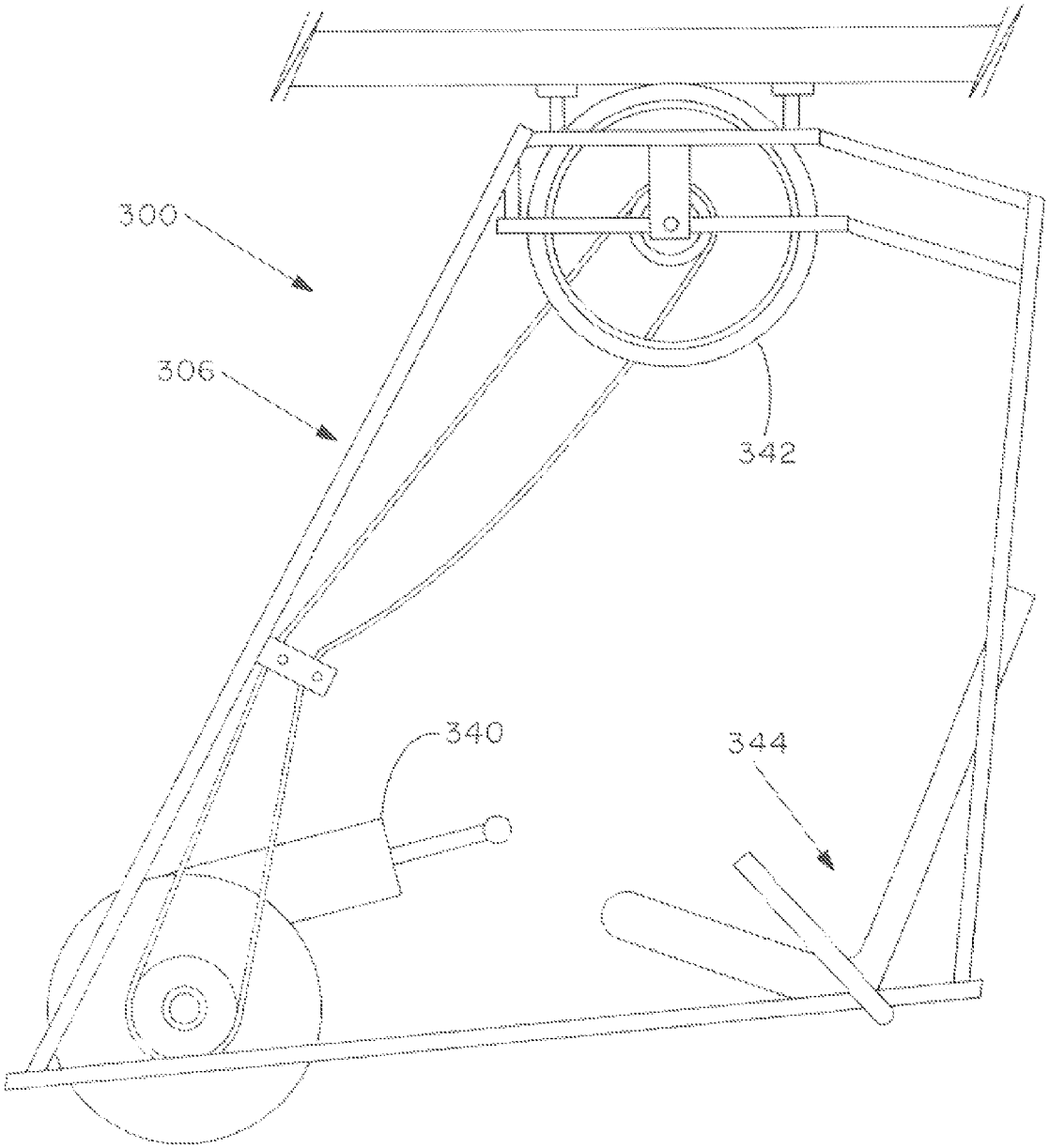
FIG. 8 illustrates a further embodiment of a carrier suspended from the rail system from FIG. 7.
Figure 9:
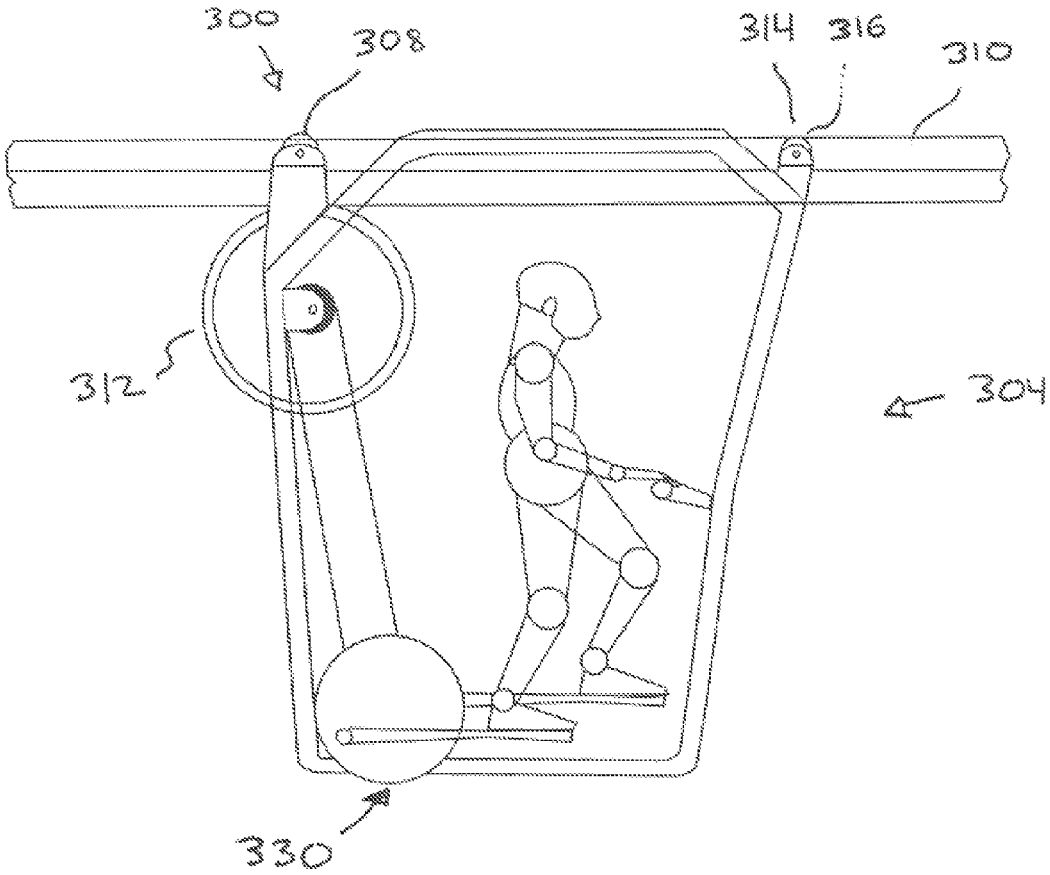
FIG. 9 illustrates yet another embodiment of a carrier suspended from the rail system from FIG. 7.

FIGS. 7-9 show an interchangeable coupling assembly 300 for use with a plurality of carriers 302, 304, 306. In these embodiments, the coupling assembly 300 includes one or more sets of rollers 308 configured to be slidably received within a channel of the elevated rail assembly 310. The coupling assembly 300 is similar to that shown in FIGS. 2A and 2B except that the translation wheel has been eliminated. Instead, the coupling assembly 300 is selectively coupled to a carrier 302, 304, 306 such that the drive wheel 312 of the carrier directly contacts the bottom surface of the elevated rail 310. As shown, the carrier 302, 304, 306 may further incorporate a second coupling assembly 314 that includes a set of rollers 316 that are received within the channel extending about the elongate dimension of the elevated rail 310.

The coupling assembly 300 is configured to allow various carriers and carrier configurations to be selectively and interchangeably coupled to the coupling assembly 300. The combination of the coupling assembly 300 and carrier 302, 304, 306 shown in FIGS. 7-9 may further include the various features and functions discussed with reference to the previous embodiments, including but not limited to a brake assembly, tension members, limit rollers and the like.

FIG. 7 shows a bicycle carrier 302 similar to that of previous embodiments wherein a frame is constructed to support a seat assembly 320 allowing access to a pedal assembly 322 for providing a mechanical force to the wheel assembly 324.

FIG. 8 shows a rowing machine carrier 306 having a seat assembly 344 and at least one rowing assembly 340 coupled to the drive wheel assembly 342 to provide a rotational force thereto when the rowing assembly 340 is rotated.

FIG. 9 shows an elliptical carrier 304 wherein the elliptical assembly 330 is coupled to the drive wheel 312 and the carrier 304 is configured such that a user may selectively operate the elliptical assembly 330 for advancement of the carrier 304 along the rail 310.

It is contemplated that any number of fitness, recreational and exercise machines, arrangements and combinations may be configured to be selectively coupled to the coupling mechanism including but not limited to various bicycle machines, rowing machines, elliptical machines, treadmills, tandem bicycles and/or tandem carriers for carrying multiple persons therein and possibly including single or multiple pedal assemblies and the like. In each case the motive assembly, such as a pedal assembly or rowing assembly or treadmill assembly or elliptical assembly other such manually driven assembly can be coupled to the drive mechanism to provide a motive force thereto.

It is additionally contemplated that the design of the carrier may encompass any number of modifications and arrangements for ergonomics and functionality and ease of manufacture in accordance with the present invention and such designs are not limited to those provided herein.

It is also contemplated that the intended use of the present invention may be as a fitness, exercise or recreational apparatus or as a travel device including but not limited to allowing travel through minimum impact areas or constructing such elevated rails along pipelines for inspection thereof and any other suitable uses for the present invention.

Figure 10:
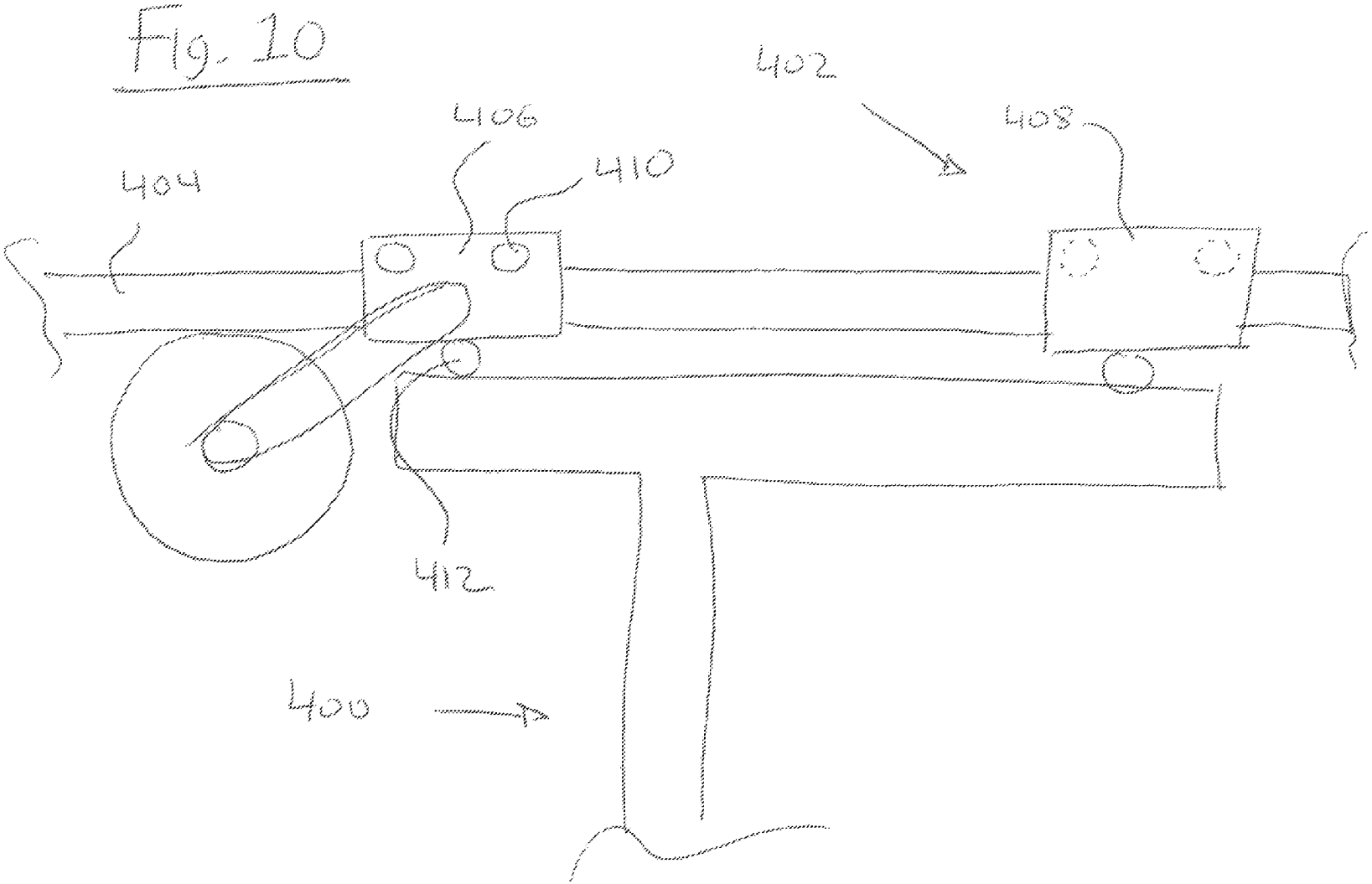
FIG. 10 illustrates another embodiment of a coupling assembly and rail system.

FIG. 10 shows yet another embodiment of a carrier 400 and coupling assembly 402 in accordance with the present invention. In this embodiment, the coupling assembly 402 is designed to couple to a square or rounded cross-section of a rail 404. The coupling assembly 402 includes one or more sections 406, 408 each having one or more sets of load wheels 410 for engaging a top portion of the rail 404. The coupling assembly 402 includes any suitable connecting member 412 or mechanism for coupling to the carrier 400.

It is further contemplated that the carriers in accordance with the present invention may include additional functional features including but not limited to those described above such as a hand brake, a throttle, a steering fin and the like. It is further contemplated that such carriers may be configurable to be encapsulated such that a rider is in an enclosed environment. The encapsulated compartment may further include but is not limited to amenities such as heat and air conditioning, such as for use of the carrier in inclimate weather.

The various embodiments described herein are illustrative of the present invention and not limiting as to the scope and spirit of the present invention.

What is claimed is:

1. A recreational apparatus comprising:

a) an elevated rail system including a plurality of intersecting carrier rails with each of such carrier rails defining a distinct carrier pathway and being adapted to suspend a carrier therefrom, said elevated rail system further including one or more diverters to enable said carrier to be selectively guided to a different carrier rail;

b) a plurality of carriers, each carrier being suspended from a respective one of said carrier rails, said carrier comprising:

i) a coupling assembly for slidably coupling said carrier to said elevated rail system, said coupling assembly including a mechanism for selectively interacting with said diverter within an interior of a first carrier rail to thereby guide said carrier from solely said first carrier rail to solely a second carrier rail;

ii) a drive wheel assembly configured to cooperate with said coupling assembly; and iii) a non-motorized motivation mechanism drivably coupled to said drive wheel assembly through a movable linkage secured between said motivation mechanism and said drive wheel assembly, wherein said non-motorized motivation mechanism is manually actuated to move said linkage, and to thereby motivate said drive wheel assembly to selectively advance said carrier along said elevated rail system.

2. The recreational apparatus according to claim 1 wherein said carrier pathway includes at least one curved section.

3. The recreational apparatus according to claim 1 wherein said elevated rail system further comprises a loading section.

* * * * *